US005697295A

United States Patent [19]

Schmid

[11] Patent Number: 5,697,295

[45] Date of Patent: Dec. 16, 1997

[54] DEVICE FOR WRAPPING A FLEXIBLE PRINT IMAGE CARRIER AROUND A PRINTING FORM CYLINDER

[75] Inventor: Gotthard Schmid, Malsch, Germany

[73] Assignee: Heidelberger Druckmaschinen AG, Heidelberg, Germany

[21] Appl. No.: 550,357

[22] Filed: Oct. 30, 1995

[30] Foreign Application Priority Data

Oct. 28, 1994 [DE] Germany ..... 44 38 482.3
Sep. 9, 1995 [DE] Germany ..... 195 33 442.6

[51] Int. Cl.[6] ..... B41F 5/24

[52] U.S. Cl. ..... 101/212; 101/415.1; 101/141

[58] Field of Search ..... 101/212, 407.1, 101/409, 410, 411, 415.1, 389.1, 141

[56] References Cited

U.S. PATENT DOCUMENTS

| | | | |
|---|---|---|---|
| 4,231,652 | 11/1980 | Moser et al. . | |
| 4,769,652 | 9/1988 | Cleary et al. | 346/136 |
| 5,355,795 | 10/1994 | Moss et al. | 101/141 |
| 5,413,043 | 5/1995 | Fuhrmann et al. | 101/415.1 |
| 5,435,242 | 7/1995 | Kusch et al. | 101/142 |

FOREIGN PATENT DOCUMENTS

| | | | |
|---|---|---|---|
| 4303872 | 10/1993 | Germany . | |
| 73987 | 4/1987 | Japan | 101/116 |
| 73988 | 4/1987 | Japan | 101/116 |

*Primary Examiner*—Edgar S. Burr
*Assistant Examiner*—Daniel J. Colilla
*Attorney, Agent, or Firm*—Herbert L. Lerner; Laurence A. Greenberg

[57] ABSTRACT

Device for wrapping a flexible print image carrier around a printing form cylinder installed in a printing press, having a rewinding mechanism including a first winding spool for unwinding a print image carrier which is windable onto an outer cylindrical surface of the printing form cylinder, and a second winding spool for winding up the print image carrier from the outer cylindrical surface of the printing form cylinder, both of the winding spools being jointly disposed in a cavity formed in the interior of the printing form cylinder, the cavity having a single opening thereto formed in the outer cylindrical surface of the printing form cylinder, the print image carrier being windable from the first winding spool through the single opening onto the outer cylindrical surface of the printing form cylinder and being windable from the outer cylindrical surface of the printing form cylinder through the single opening onto the second winding spool, includes a bearing member supporting the rewinding mechanism for the print image carrier, the bearing member being disposed in the interior of the printing form cylinder and being removable from the interior of the printing form cylinder while the printing form cylinder remains in installed position thereof in the printing press.

10 Claims, 5 Drawing Sheets

1
2
4
9
10
11
12
13
14
15
16
17
17
18
19
20
21
22

DEVICE FOR WRAPPING A FLEXIBLE PRINT IMAGE CARRIER AROUND A PRINTING FORM CYLINDER

BACKGROUND OF THE INVENTION

Field of the Invention

The invention relates to a device for wrapping or winding a flexible print image carrier around a printing form cylinder, including a first winding spool for unwinding a print image carrier which is windable onto an outer cylindrical surface of the printing form cylinder, and a second winding spool for winding up the print image carrier which has been wound onto the outer cylindrical surface of the printing form cylinder, both of the winding spools being jointly disposed in a cavity formed in the interior of the printing form cylinder, the cavity having a single opening thereto formed in the outer cylindrical surface of the printing form cylinder, the print image carrier being windable from the first winding spool through the single opening onto the outer cylindrical surface of the printing form cylinder and being windable from the outer cylindrical surface of the printing form cylinder through the single opening onto the second winding spool.

From the prior art represented by U.S. Pat. No. 4,231,652, by way of example, a drum for a copier has become known heretofore, in the interior of which two spools, namely a supply spool and a take-up spool, are received for transporting a weblike semiconductor material. The drum, together with the winding spools supported therein, is removable from the bearing support therefor, for which purpose levers located opposite the end faces of the drum are form-lockingly connected to journal pins withdrawable from and redrawable back into bores formed in the end faces of the drums. It is noted in this regard that a form-locking connection locks elements together due to the shape of the elements themselves, as opposed to a force-locking connection which locks elements together by force external to the elements. By means of the swivellable levers, the journal pins can be moved axially; after the journal pins have cleared the bores in the end faces, the drum rests on support pins secured to the side walls.

The published German Patent Document DE 43 03 872 A1 shows a printing device with a form cylinder, and describes a method for making ready or preparing the form cylinder for printing. In one of the disclosed embodiments, the form cylinder is subdivided into two segments which are form-lockingly connected to one another. In this embodiment, the winding spools which receive the print image carrier are accommodated in the upper segment, and removal of the winding spools when the supply spool runs out is either possible through the end face of the form cylinder, or may require a complete removal of the upper segment. A removal in the press of the segment which receives the winding spool appears to be complicated and difficult, in view of the size of the component; removal of the winding spools through the end faces requires the removal of the form cylinder from the printing press.

In light of the state of the prior art as outlined above, it is accordingly an object of the invention to provide a device for wrapping a printing form cylinder with a flexible print image carrier, wherein the friendliness or ease of servicing of a form cylinder which maintains a wrappable print image carrier at hand is improved, and shut-down times are minimized.

SUMMARY OF THE INVENTION

With the foregoing and other objects in view, there is provided, in accordance with the invention, a device for wrapping a flexible print image carrier around a printing form cylinder installed in a printing press, having a rewinding mechanism including a first winding spool for unwinding a print image carrier which is windable onto an outer cylindrical surface of the printing form cylinder, and a second winding spool for winding up the print image carrier from the outer cylindrical surface of the printing form cylinder, both of the winding spools being jointly disposed in a cavity formed in the interior of the printing form cylinder, the cavity having a single opening thereto formed in the outer cylindrical surface of the printing form cylinder, the print image carrier being windable from the first winding spool through the single opening onto the outer cylindrical surface of the printing form cylinder and being windable from the outer cylindrical surface of the printing form cylinder through the single opening onto the second winding spool, comprising a bearing member supporting the rewinding mechanism for the print image carrier, the bearing member being disposed in the interior of the printing form cylinder and being removable from the interior of the printing form cylinder while the printing form cylinder remains in installed position thereof in the printing press.

In accordance with another feature of the invention, the bearing member is disposed in vicinity of an end face of the printing form cylinder.

In accordance with a further feature of the invention, the first and the second winding spools forming part of the rewinding mechanism for the printed image carrier are supported in the interior of the printing form cylinder by the bearing part.

In accordance with an added feature of the invention, the bearing part is detachably secured to at least one of two end parts of the printing form cylinder forming a respective end face thereof.

In accordance with an additional feature of the invention, the bearing part is threadedly fastened to the one end part of the printing form cylinder.

In accordance with yet another feature of the invention, the end parts of the printing form cylinder and the bearing part are formed with openings for receiving the rewinding mechanism therein.

In accordance with yet a further feature of the invention, the printing form cylinder includes a middle part, a first end part forming an end face of the printing form cylinder, a second end part forming another end face of the printing form cylinder, and a removable bearing part.

In accordance with yet an added feature of the invention, the winding spools are journalled, at one end thereof, in an end part forming an end face of the printing form cylinder and, at the other end thereof, in the bearing part.

In accordance with yet an additional feature of the invention, the end parts of the printing form cylinder are formed with respective integrated bearer rings.

In accordance with a concomitant feature of the invention, the printing form cylinder has an outer cylindrical surface, and the integrated bearer rings are formed with bearing surfaces at both ends of the outer cylindrical surface of the printing form cylinder.

It is thus advantageous in the aforedescribed structure of the invention that the form cylinder remains in its installed condition in the printing press while maintenance work is being performed. The rewinding or rewrapping mechanism, together with the winding or wrapping shafts, is removable in a relatively simple manner through the opening formed in the peripheral or outer cylindrical surface of the form cylinder. After the aforementioned mechanism and winding shafts have been removed, the bearing part which supports the winding shafts can also be removed in a relatively simple manner from the cylinder interior, with the result that the entire interior of the cylinder becomes freely accessible through the circumferential opening for maintenance work. Disassembly or removal of the form cylinder is thereby rendered superfluous. Due to this circumstance, danger of damage or shifting of the imaging units positioned close to the surface of the form cylinder is drastically reduced. Upon the removal or disassembly and subsequent ensuing reinstallation or reassembly of the form cylinder in the printing press, conversely, a readjustment of the imaging units could not possibly be avoided. However, this otherwise necessary yet undesirable downtime can be eliminated as well, with the device according to the invention.

In a further feature of the concept upon which the invention is based, the bearing part is disposed in the vicinity of a part forming one of the end faces of the printing form cylinder. The first and second winding spools of the rewinding mechanism for the print image carrier is supported in the interior of the printing form cylinder by the bearing part. The bearing part may be secured to one of the cylinder end parts, and the winding spools are received, on one hand, in the bearing part and, on the other hand, in the respective cylinder end part opposite thereto. Both the bearing part and the respective cylinder end part for receiving the winding spool are provided with openings for receiving the winding spools. To improve the dimensional accuracy for final surface finishing, integrated bearer rings or Schmitz rings are provided in the cylinder end parts of the printing form cylinder and are formed with bearing surfaces disposed adjacent to and extending along the outer cylindrical shell surface of the printing form cylinder.

Other features which are considered as characteristic for the invention are set forth in the appended claims.

Although the invention is illustrated and described herein as embodied in a device for wrapping a flexible printed image carrier around a form cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
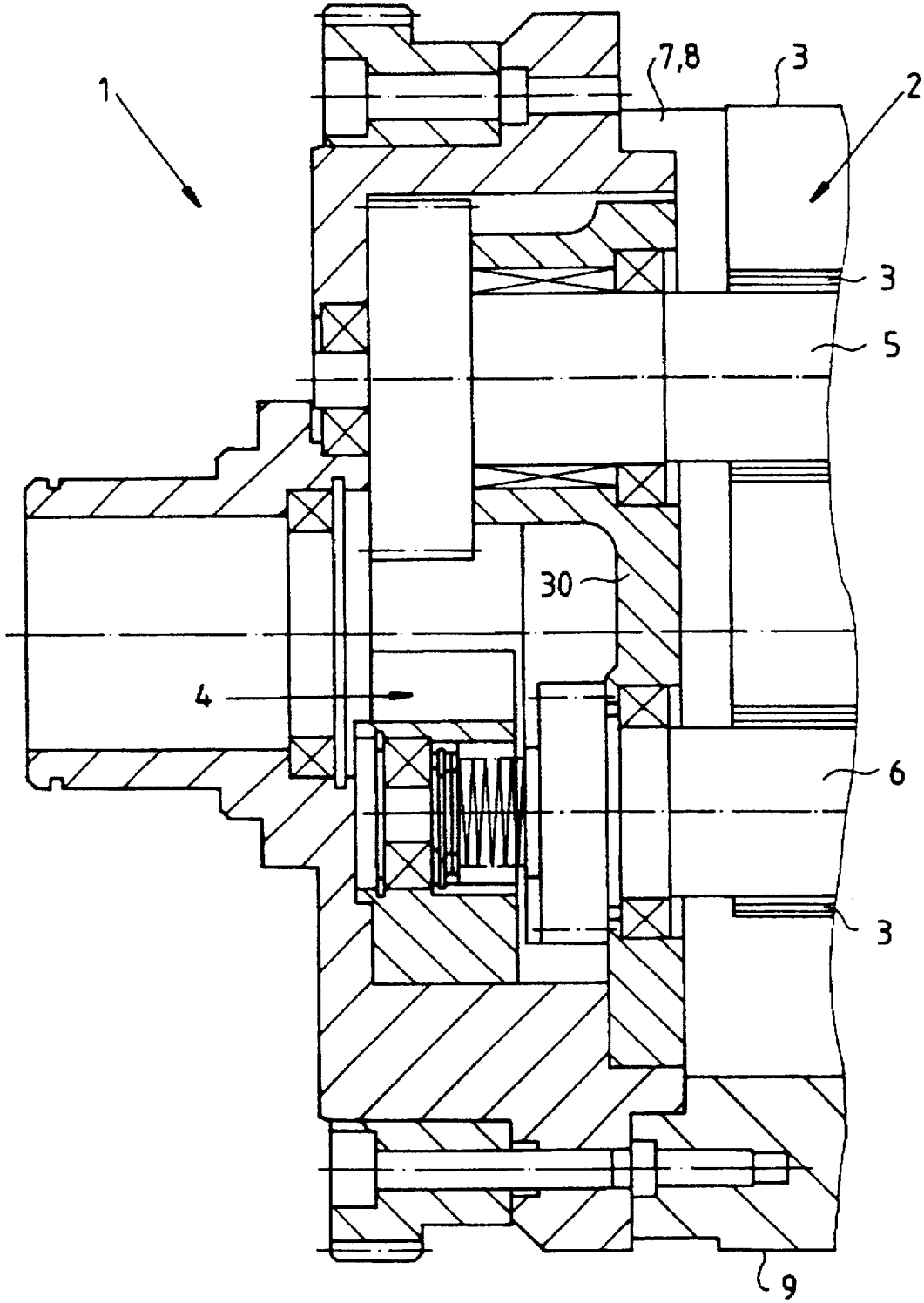
FIG. 1, a section through a form cylinder with a bearing part for the printed image carrier spools.
Figure 5:
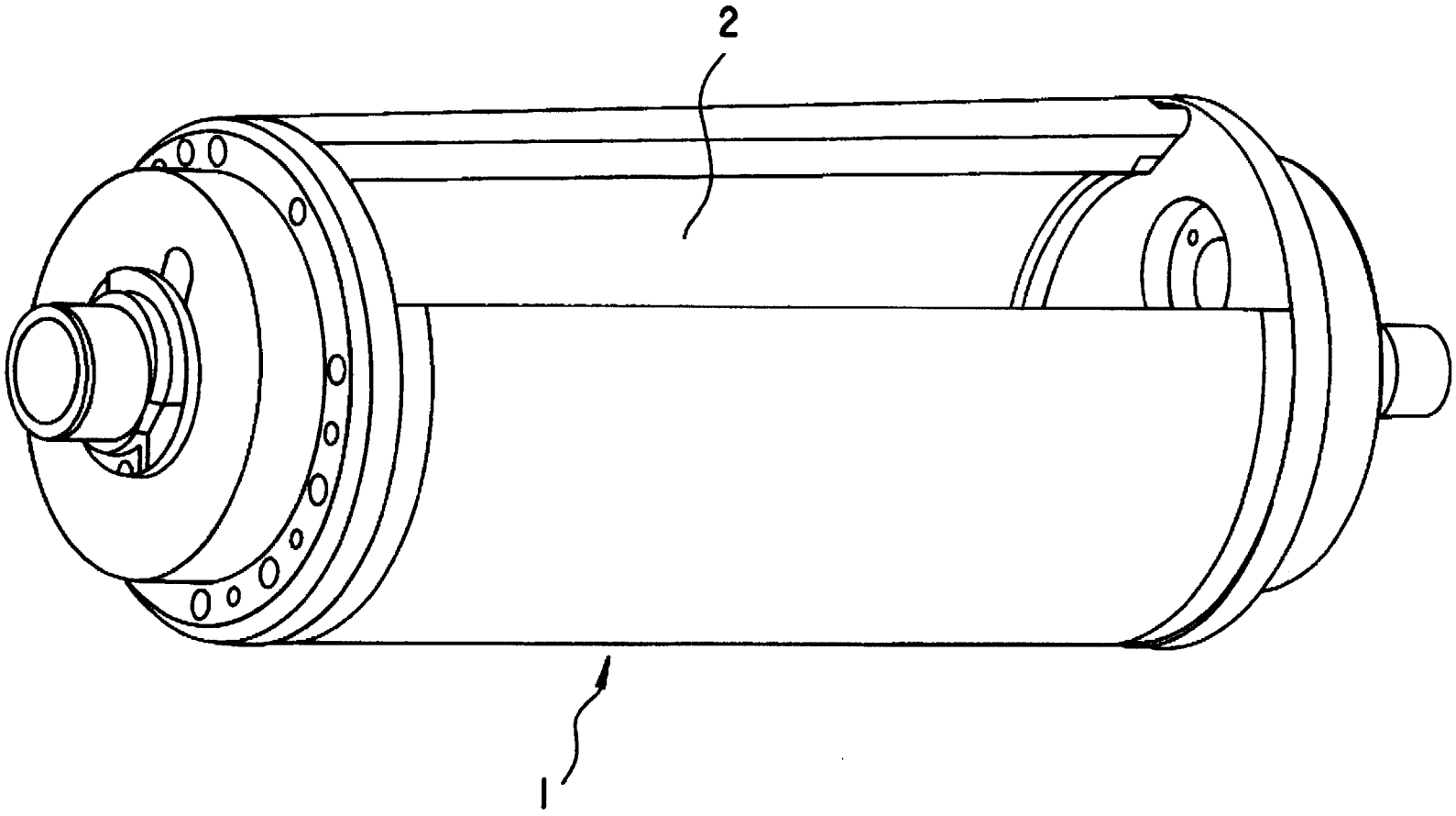
FIG. 5 is a perspective view of the form cylinder.

In the view of FIG. 1, a form cylinder 1 is shown that has a circumferential opening 2 (see FIG. 5) in its jacket face 9. A rewinding mechanism 4, which includes winding spools 5 and 6, is received in the interior of the form cylinder 1. By means of these winding spools 5 and 6, of which one receives a supply of the printed image carrier 3, while the other serves to receive the printed image carrier portion unwound from the jacket face 9, or in other words the used portion, the printed image carrier 3 is transported again, depending on the print job to the jacket face 9 of the form cylinder 1 so as to be copied directly on to it. The image copying units themselves are not the subject of the present invention; they are mentioned only to the extent that they must be correctly positioned against the surface of the form cylinder 1, in order to assure correct copying of whichever printed image carrier 3 is located on the jacket face 9 at the time. When maintenance work is done on the form cylinder 1, the correct adjustment of the copying units with respect to the surface of the printed image carrier 3 should be preserved if at all possible.

A bearing part 30 receives the winding spools 5 and 6 serving to feed the printed image carrier. To avoid damage to the printed image carrier 3 and to maintain its uniform tension, the printed image carrier 3 is guided via rounded portions 7, 8 which the conduit opening 2 in the jacket face 9 defines.

Figure 2:
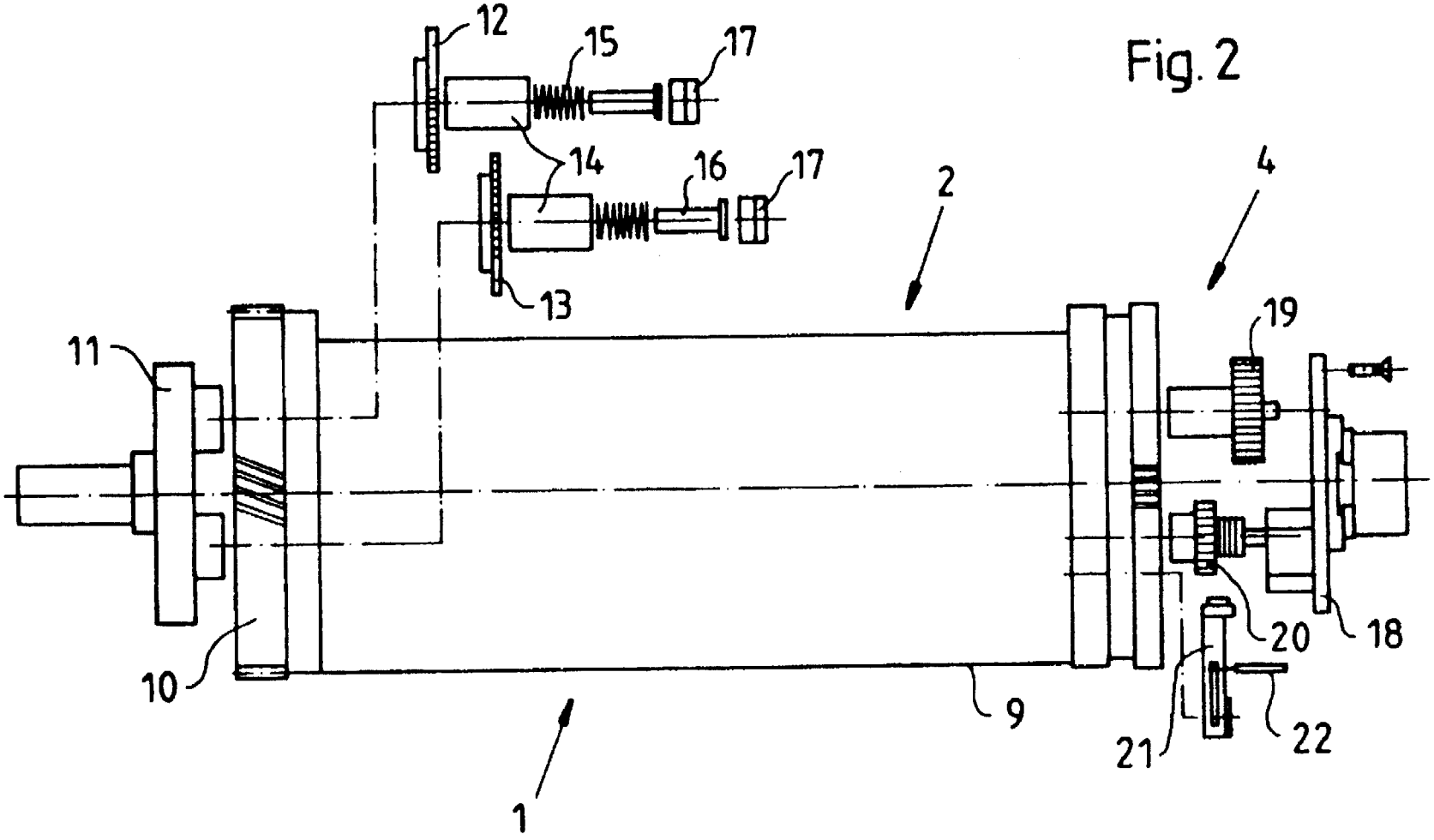
FIG. 2, a form cylinder with cylinder face ends that are removable conventionally outside the machine.

FIG. 2 shows a form cylinder of a conventional design, with spindle holders disposed on the face end outside the cylinder, the spindle holders being removable in the axial direction.

Located on the face end of the form cylinder 1 on which the first spindle holder 11 is located is an obliquely toothed drive wheel 10 for driving the form cylinder. In the installed state, spindle shafts 14 are received in the first spindle holder 11. Each of the spindle shafts 14 is provided with a toothed segment 12, 13, by which simultaneous locking of both winding spools 5, 6 for the printed image carrier 3 can be done. All that is needed to do so is to actuate the first segment 12. The spindle shafts 14 each receive compression springs 15, through which a bolt 16 extends. The bolts 16 in turn have removable spindle heads 17, which in turn fix the ends of the winding spools 5 and 6. On the opposite face end of the form cylinder 1, a second spindle holder 18 is provided, which is again removable from the form cylinder 1 only from the outside. The second spindle holder 18 receives both a gear wheel 19 and a ratchet wheel 20, which cooperates with a detent pawl 21, which in turn is prestressed by a spring 22. By means of the detent pawl 21 one of the winding spools 5, 6 can be blocked in its position, while by means of further rotation of the other winding spool the printed image carrier 3 can be employed over the jacket face 9 of the form cylinder 1.

The view shown in FIG. 2 shows parts of the rewinding mechanism 4. Replacing the parts of the rewinding mechanism 5 requires removal of the spindle holder 18 outside the machine.

Figure 3:
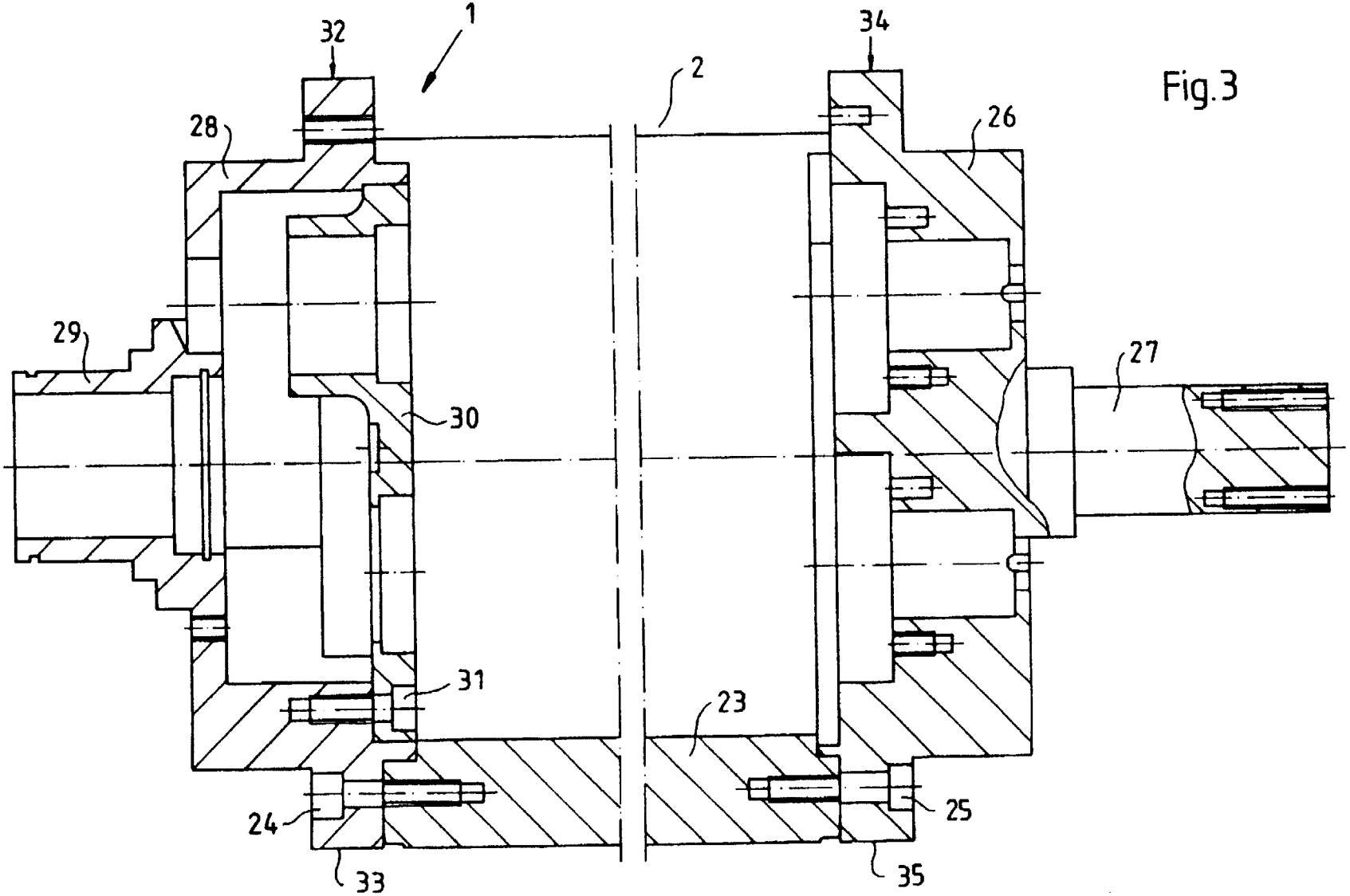
FIG. 3, a cross section through the form cylinder with bearing parts and image carrier rewinding parts that are removable in the machine, and FIG. 4, a winding spool bearing on one face end of the form cylinder, with winding spool bearing guide journals screwed to the face end.

In a configuration according to the invention shown in FIG. 3, the removal of the outer spindle holder 11, which results in the removal of the form cylinder 1 from the machine, can be dispensed with. The form cylinder 1 according to the invention includes a first cylinder end part 26 and a second cylinder end part 28, between which a middle piece 23 is screwed with bolts 24 and 25. The middle piece 23 includes a circumferential opening 2. A journal 27 and 29 is embodied in each of the cylinder end parts 26 and 28, respectively, and by means of it the cylinder 1 is supported in the machine. A bearing part 30 is disposed on one of the cylinder face ends 26 or 28 - in this case on the second cylinder end part 28. This bearing part 30 is provided with openings, which receive components of the rewinding mechanism 4 shown in further detail in FIG. 2. The bearing part 30 may be joined to the second cylinder end part 28 via a screw fastening 31, for example. If the supply of printed image carrier on one of the winding spools 5, 6 is exhausted, then these spools are moved away from the spindle heads 17 by rotation of the toothed segments 12 and 13 and by cancellation of the prestressing of the compression spring 15, and are removed through the circumferential opening 2. In the event that servicing is done, once again the screw fastening 31 between the bearing part 30 and the corresponding cylinder end part can be undone through the circumferential opening 2; the bearing part 30 is removable, together with the components of the rewinding mechanism 4 received on it, from the interior of the form cylinder 1. In comparison to this, in the configuration shown in FIG. 2 it is necessary for the second spindle holder 18 to be removed from the outside, which necessitates removal of the form cylinder i from the machine.

In the embodiment shown in FIG. 3, all the components received in the interior of the form cylinder 1 can be removed through the circumferential opening 2. The components of the rewinding mechanism 4 supported in the first cylinder end part 26 are equally readily accessible even without removing the part 30 without requiring removal of the first cylinder end part 26.

Naturally, the bearing part 30 may equally well be received on the first cylinder end part 26, in which case that cylinder end part should be embodied like the second cylinder end part 28.

The cylinder end parts 26 and 28 each have respective integrated bearer rings 32 and 34. As a result of this one-piece embodiment, there is no seam and hence no problem of tolerance in surface machining of the running faces 33 and 35, respectively. Accordingly the possibility exists, in final surface machining of the first cylinder end part 26, for both it and the running face 35 to be ground to their final state together. The second cylinder end part 28 should be machined in a similar way.

The running faces 33, 35, along with all the other precision outer diameters, are ground to final condition once the parts 23, 27 and 29 have been installed. This guarantees perfect accuracy of concentricity of these diameters with respect to one another.

Figure 4:
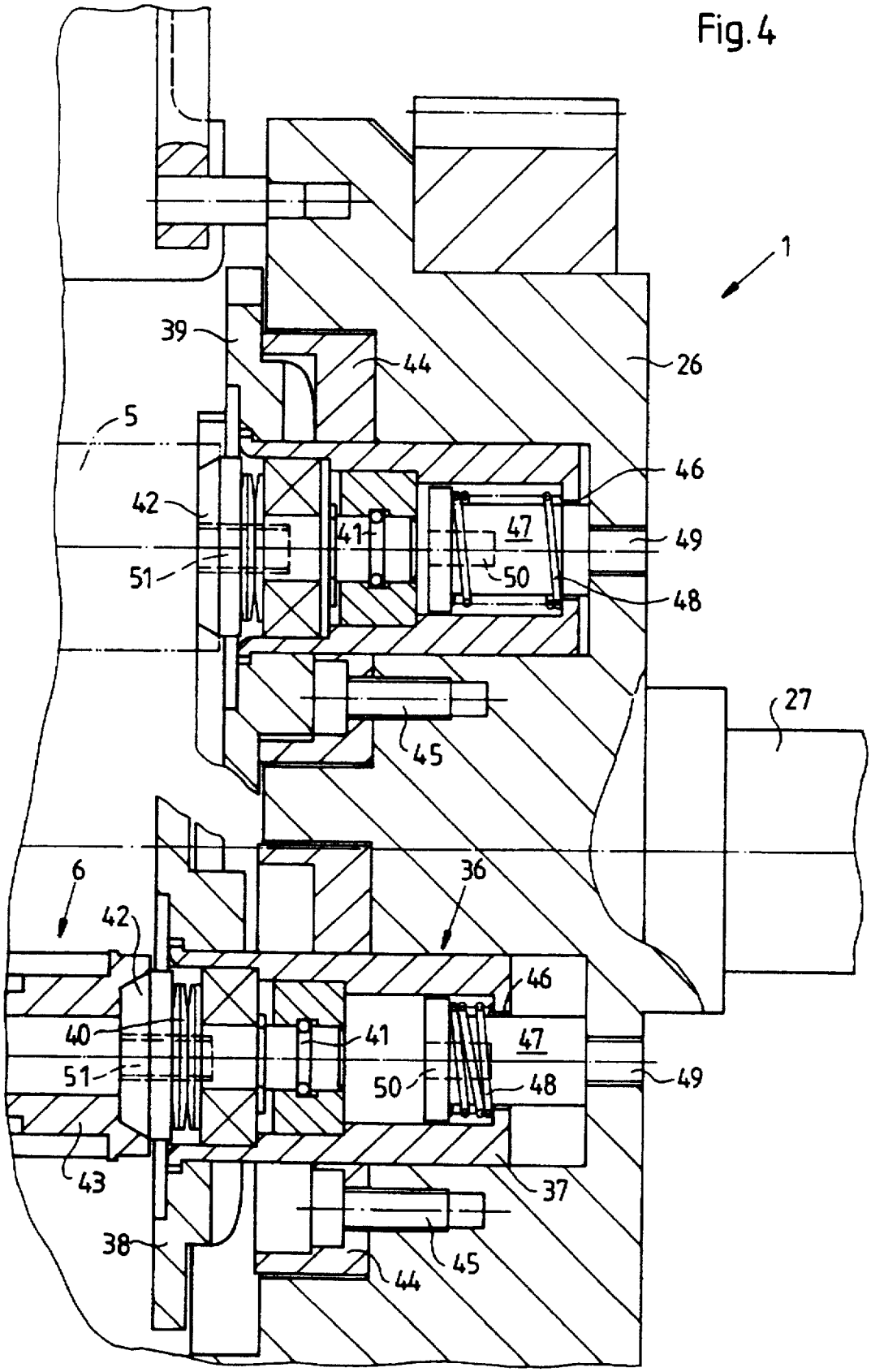

FIG. 4 shows a fourth variant of a winding spool bearing.

In this view, the winding spool 5 is shown in a position for removal of the supply roll, while the winding spool 6 is shown in the position that it assumes during operation.

Shells 44 are mounted in the region of each of the winding spools 5, 6 in the first cylinder end part 26 of the form cylinder 1; these shells are each secured to the first cylinder end part 26 by a screw fastening 45. The journal 27 of the form cylinder 1 is supported in the side wall of the machine, which is not shown here, however, so that access to the first cylinder part 26 from outside through the side wall of the machine is much more difficult.

The aforementioned shells 44 are each penetrated by tubes 37, on each of which a toothed segment 38 and 39, a cone 42, and rollers bearings as well as a journal 47 prestressed by a spring 48 are provided. The journals 47 are screwed in the first cylinder end part 26 by means of a journal thread 49 and embody the inner guide of the tubes 37.

On each of the tubes 37 a toothed segment 38, 39 is provided, so that in the feeding of the printed image carrier 3 it is assured that identical winding paths will be traversed by the winding spools. Moreover, each cone 42 is provided with an internal thread 51, so that after the respective winding spools 5 or 6 have been removed the cone can simply be removed from the tubes 37. The plane sides of the journals 47 are then exposed, so that by means of a tool to be introduced into the journal thread 51 the journals can be rotated, and thus the journal thread 49 and hence the journal 47 is removable from the first cylinder end part 26.

The position of the winding spool 6 in the operating state is shown for the lower winding spool 6, which is also shown in FIG. 4. The spring 48 keeps the tube 37 in a prestressed position on the journal 47 and thus fixes the winding spool 6 axially. Upon deflection of the tube 37, the spring 50 is tensed, and as a result the toothed segments 38, 39 that mesh with one another come out of engagement. In the state shown in FIG. 4, the two toothed segments 38, 39 are out of engagement; the upper one of the tubes 37 is displaced counter to the action of the spring 50, while the lower one of the tubes 37 is held in its operating position by the action of the spring 48, so that a secure hold for the winding spool 6 shown there is provided.

I claim:

1. A device in combination with a printing form cylinder for wrapping a flexible print image carrier around the printing form cylinder while it is installed in a printing press, said printing form cylinder having end faces, said device having a rewinding mechanism including a first winding spool for unwinding a print image carrier which is windable onto an outer cylindrical surface of the printing form cylinder, and a second winding spool for winding up the print image carrier from the outer cylindrical surface of the printing form cylinder, both of the winding spools being jointly disposed in a cavity formed in the interior of the printing form cylinder, the cavity having a single opening thereto formed in the outer cylindrical surface of the printing form cylinder, the print image carrier being windable from the first winding spool through the single opening onto the outer cylindrical surface of the printing form cylinder and being windable from the outer cylindrical surface of the printing form cylinder through the single opening onto the second winding spool, comprising a bearing member supporting the rewinding mechanism for the print image carrier, said bearing member being disposed in the interior of the printing form cylinder, said bearing member being mounted to one end face of the printing form cylinder and being removable from the interior of the printing form cylinder via the single opening formed in the outer cylindrical surface while the printing form cylinder remains in an installed position thereof in the printing press.

2. Device according to claim 1, wherein said bearing member is disposed in a fixed and stationary manner within the printing form cylinder and removal of said bearing member allows for easy removal of other internal printing form cylinder components through the single opening formed in the outer cylindrical surface.

3. Device according to claim 1, wherein said first and said second winding spools are supported by said bearing part.

4. Device according to claim 1, wherein said printing form cylinder has two end parts with end faces formed thereon and said bearing part is detachably secured to at least one of said two end parts of the printing form cylinder.

5. Device according to claim 4, wherein said bearing part is threadedly fastened to said one end part of the printing form cylinder.

6. Device according to claim 4, wherein said end parts of the printing form cylinder and said bearing part are formed with openings for receiving the rewinding mechanism therein.

7. Device according to claim 1, wherein the printing form cylinder includes a middle part, a first end part forming an end face of the printing form cylinder, a second end part forming another end face of the printing form cylinder, and a removable bearing part.

8. Device according to claim 1, wherein said winding spools each have a first end and a second end, said first end being journalled in an end part forming an end face of the printing form cylinder and said second end being journalled in said bearing part.

9. Device according to claim 4, wherein said end parts of the printing form cylinder are formed with respective integrated bearer rings.

10. Device according to claim 9, wherein said integrated bearer rings are formed with bearing surfaces at both ends of said outer cylindrical surface of the printing form cylinder.

* * * * *